US008373696B2

(12) United States Patent
Miyazawa

(10) Patent No.: US 8,373,696 B2
(45) Date of Patent: Feb. 12, 2013

(54) ELECTRO-OPTICAL DEVICE, METHOD OF DRIVING THE SAME, AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 12/837,594

(22) Filed: Jul. 16, 2010

(65) Prior Publication Data

US 2010/0277402 A1 Nov. 4, 2010

Related U.S. Application Data

(63) Continuation of application No. 10/921,867, filed on Aug. 20, 2004, now abandoned.

(30) Foreign Application Priority Data

Aug. 29, 2003 (JP) ..... 2003-306803
Jun. 29, 2004 (JP) ..... 2004-191356

(51) Int. Cl.
*G09G 5/00* (2006.01)

(52) U.S. Cl. ..... 345/212; 345/76

(58) Field of Classification Search ..... 345/212, 345/76

See application file for complete search history.

(56) References Cited

U.S. PATENT DOCUMENTS

| | | | | |
|---|---|---|---|---|
| 5,432,527 | A | 7/1995 | Yanai et al. | |
| 6,380,689 | B1 | 4/2002 | Okuda | |
| 6,825,834 | B2 | 11/2004 | Miyajima | |
| 7,113,154 | B1 | 9/2006 | Inukai | |
| 7,167,169 | B2 * | 1/2007 | Libsch et al. | 345/211 |
| 7,209,101 | B2 * | 4/2007 | Abe | 345/76 |
| 7,230,591 | B2 | 6/2007 | Inukai | |
| 7,250,928 | B2 | 7/2007 | Yamazaki et al. | |
| 7,317,429 | B2 | 1/2008 | Shirasaki et al. | |
| 2003/0107565 | A1 | 6/2003 | Libsch et al. | |
| 2003/0112205 | A1 | 6/2003 | Yamada | |
| 2003/0210212 | A1 * | 11/2003 | Li et al. | 345/76 |
| 2004/0041750 | A1 | 3/2004 | Abe | |
| 2004/0080882 | A1 | 4/2004 | Miyazawa | |
| 2004/0095338 | A1 | 5/2004 | Miyazawa | |
| 2004/0100427 | A1 | 5/2004 | Miyazawa | |
| 2005/0083270 | A1 | 4/2005 | Miyazawa | |

FOREIGN PATENT DOCUMENTS

| | | |
|---|---|---|
| CN | A 1402211 | 3/2003 |
| JP | A-2001-109432 | 4/2001 |
| JP | A-2001-343933 | 12/2001 |
| JP | A-2002-207442 | 7/2002 |
| JP | A-2002-358048 | 12/2002 |
| JP | A-2003-122304 | 4/2003 |

(Continued)

OTHER PUBLICATIONS

Office Action issued in JP Application No. 2004-244833 on Dec. 14, 2010 (with English translation).

(Continued)

*Primary Examiner* — Yong H Sim
(74) *Attorney, Agent, or Firm* — Oliff & Berridge, PLC

(57) ABSTRACT

An aspect of the present invention provides an electro-optical device including a plurality of scanning lines, a plurality of data lines, a plurality of power lines extending in a direction intersecting with the plurality of data lines, and a plurality of pixel circuits provided corresponding to intersections of the plurality of scanning lines and the plurality of data lines, wherein pixel circuits of the plurality of pixel circuits provided adjacent to each other along one of the plurality of data lines is coupled to one of the plurality of power lines.

11 Claims, 13 Drawing Sheets

FOREIGN PATENT DOCUMENTS

| | | |
|---|---|---|
| JP | A-2003-150108 | 5/2003 |
| JP | A-2003-167550 | 6/2003 |
| JP | A-2003-186436 | 7/2003 |
| JP | A-2003-195810 | 7/2003 |
| JP | A-2003-195814 | 7/2003 |
| JP | A-2003-216103 | 7/2003 |
| JP | A-2003-295824 | 10/2003 |
| JP | A-2004-7572 | 1/2004 |
| JP | A-2004-70074 | 3/2004 |
| JP | A-2004-145278 | 5/2004 |
| WO | WO 03/058328 A1 | 7/2003 |

OTHER PUBLICATIONS

Nov. 21, 2011 Office Action issued in Japanese Application No. 2004-244833 (with translation).

* cited by examiner

ELECTRO-OPTICAL DEVICE, METHOD OF DRIVING THE SAME, AND ELECTRONIC APPARATUS

This is a Continuation of U.S. patent application Ser. No. 10/921,867 filed Aug. 20, 2004. The disclosure of the prior application is hereby incorporated by reference herein in its entirety.

BACKGROUND OF THE INVENTION

1. Field of Invention

The present invention relates to an electronic device, such as an electro-optical device, a method of driving the same, and an electronic apparatus, and more particularly, to the commonality of power lines through which a voltage is applied to pixel circuits.

2. Description of Related Art

Display devices using organic electronic luminescence (EL) elements have lately attracted considerable attention. The organic EL element is a current driven element whose brightness is set according to a driving current passing therethrough. A method of writing data to pixels using the organic EL elements includes a current program method in which data are supplied to data lines based on a current and a voltage program method in which data are supplied to data lines based on a voltage.

SUMMARY OF THE INVENTION

A first electro-optical device of the present invention includes a plurality of scanning lines, a plurality of data lines; a plurality of power lines extending in a direction intersecting with the plurality of data lines, a plurality of pixel circuits provided corresponding to intersections of the plurality of scanning lines and the plurality of data lines, a scanning line driving circuit that selects the plurality of scanning lines to output scanning signals to the scanning lines, and a power line control circuit that sets the voltages of the plurality of power lines to be variable in synchronism with the selection of the scanning lines by the scanning line driving circuit, wherein each of the plurality of pixel circuits is coupled to a pair of adjacent power lines of the plurality of power lines.

A second electro-optical device of the present invention includes a plurality of scanning lines, a plurality of data lines, a plurality of power lines extending in a direction intersecting with the plurality of data lines, and a plurality of pixel circuits provided corresponding to intersections of the plurality of scanning lines and the plurality of data lines, wherein pixel circuits of the plurality of pixel circuits provided adjacent to each other along one of the plurality of data lines are coupled to one of the plurality of power lines.

In the above-mentioned electro-optical devices, a change of a voltage value of one of two adjacent power lines of the plurality of power lines shifts from a change of a voltage value of the other of the two power lines by a predetermined time.

Herein, the predetermined time preferably may correspond to a horizontal scanning period.

In the above-mentioned electro-optical devices, each of the plurality of pixel circuits may include a capacitor that holds electric charge corresponding to a data current or a data voltage supplied through one of the plurality of data lines, a driving transistor whose conduction state is set based on the electric charge held in the capacitor, and an electro-optical element whose brightness is set according to the conduction state.

In the above-mentioned electro-optical devices, the power line control circuit may set voltage values of two of the plurality of power lines coupled to each of the plurality of pixel circuits to be variable in order to change the direction of a bias applied to the driving transistor.

In the electro-optical devices, one of the two power lines may be coupled to one end of the driving transistor, and the other of the two power lines may be coupled to a node between the other end of the driving transistor and the electro-optical element.

In the electro-optical devices, within a driving period, which is a part of a predetermined period, the power line control circuit may set the voltage of the one of the two power lines higher than a predetermined voltage to apply a forward bias to the driving transistor, and within a period other than the driving period, which is a part of the predetermined period, the power line control circuit may set the voltage of the other of the two power lines higher than the voltage of the one of the two power lines to apply a non-forward bias to the driving transistor.

In the electro-optical devices, the power line control circuit may set voltage values of two of the plurality of power lines coupled to each of the plurality of pixel circuits to be variable in order to change the direction of a bias applied to the electro-optical element.

In the electro-optical devices, one of the two power lines may be coupled to one end of the driving transistor, and the other of the two power lines may be coupled to a node between the other end of the driving transistor and the electro-optical element.

In the electro-optical devices, within a driving period, which is a part of a predetermined period, the power line control circuit may set the voltage of the one of the two power lines higher than a predetermined voltage to apply a forward bias to the electro-optical device, and within a period other than the driving period, which is a part of the predetermined period, the power line control circuit may set the voltage of the other of the two power lines lower than the predetermined voltage to apply a non-forward bias to the electro-optical device.

An electronic apparatus of the present invention comprises any one of the above-mentioned electro-optical devices.

The present invention provides a first method of driving an electro-optical device having a plurality of pixel circuits that are provided corresponding to intersections of a plurality of scanning lines and a plurality of data lines and each of which has an electro-optical element and a driving transistor and each of which is coupled to a pair of adjacent power lines of a plurality of power lines provided corresponding to the plurality of scanning lines, the method includes supplying a data signal to each of the plurality of pixel circuits through the plurality of data lines, applying a forward bias to the electro-optical element according to an conduction state of the driving transistor set by the data signal, applying a non-forward bias to the electro-optical element; and restoring a variation or deterioration of characteristics of the driving transistor due to the application of the forward bias.

In the method of driving an electro-optical device, the non-forward bias applying and the restoring may be performed for different periods.

In the method of driving an electro-optical device, the restoring may be performed in a state in which the electro-optical element is electrically disconnected from the driving transistor.

In the method of driving an electro-optical device, in the restoring, the non-forward bias may be applied to the driving transistor.

In the method of driving an electro-optical device, in the forward bias applying, the voltage of one of the pair of power lines may be set to be higher than a predetermined voltage to apply a forward bias to the driving transistor, and in the restoring, the voltage of the other of the pair of power lines may be set to be higher than the voltage of the one of the pair of power lines to apply a non-forward bias to the driving transistor.

The present invention provides a second method of driving an electro-optical device having a plurality of pixel circuits that are provided to correspond to intersections of a plurality of scanning lines and a plurality of data lines and each of which has an electro-optical element and a driving transistor the method includes supplying a data signal to each of the plurality of pixel circuits through the plurality of data lines, applying a forward bias to the electro-optical element according to an conduction state of the driving transistor set by the data signal, applying a non-forward bias to the electro-optical element, and applying a non-forward bias to the driving transistor.

In the method of driving an electro-optical device, the conduction state of the driving transistor set by the data signal may reflect a result of compensation of a variation of characteristics of the driving transistor.

The present invention provides a third method of driving an electro-optical device having a plurality of pixel circuits that are provided corresponding to intersections of a plurality of scanning lines and a plurality of data lines and each of which has an electro-optical element and a driving transistor, the method includes supplying a data signal to each of the plurality of pixel circuits through the plurality of data lines, applying a forward bias to the electro-optical element according to an conduction state of the driving transistor set by the data signal, and applying a non-forward bias to at least one of the electro-optical element and the driving transistor, wherein the conduction state of the driving transistor reflects a result of compensation of a variation of characteristics of the driving transistor.

In the present invention, a 'forward bias' is not univocally set, but may be appropriately set according to the purpose of use. In addition, in the present invention, a 'non-forward bias' is defined according to the setting of the 'forward bias' and means a bias in the direction opposite to the 'forward bias' or a state in which a current does not flow.

DETAILED DESCRIPTION OF PREFERRED EMBODIMENTS

1. First Exemplified Embodiment

Figure 1:
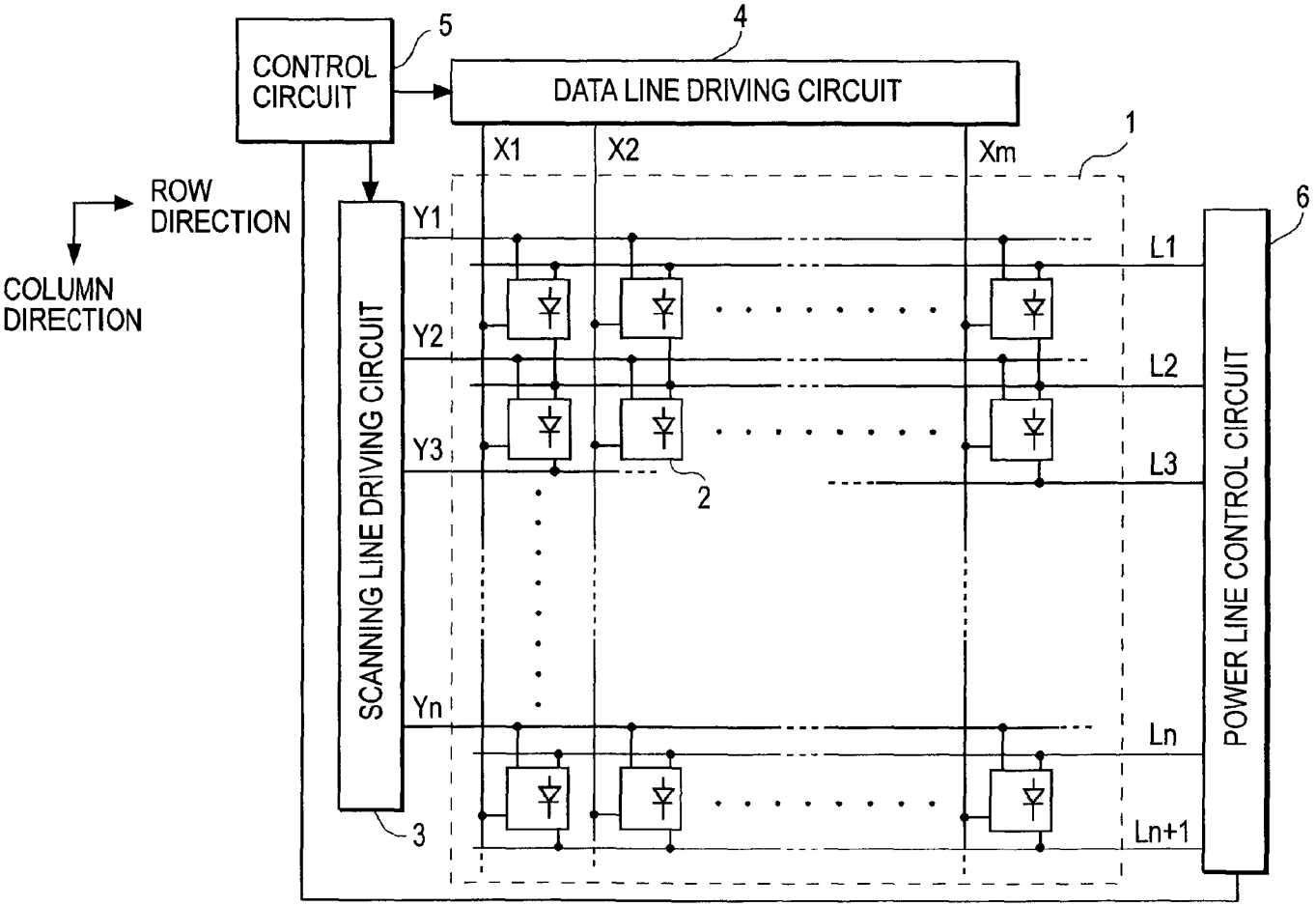
FIG. 1 is a block diagram of an electro-optical device.

FIG. 1 is a block diagram of an electro-optical device according to the present embodiment. A display unit 1 is an active matrix display panel in which electro-optical elements are driven by, for example, TFTs (Thin Film Transistors). In the display unit 1, a group of pixels composed of m dots by n lines is arranged in a matrix (in plan view). A group of scanning lines Y1 to Yn each extending in the horizontal direction and a group of data lines X1 to Xm each extending in the vertical direction are provided in the display unit 1, and pixels 2 (pixel circuits) are arranged to correspond to the intersections therebetween. In FIG. 1, a set of four scanning lines Ya to Yd is shown as one scanning line Y in consideration of the relationship with the structure of a pixel circuit according to each embodiment, which will be describe later (see FIGS. 2 and 8). In the present embodiment, one pixel 2 is a minimum display unit, but may be composed of three sub-pixels R, G, and B.

Power lines L1 to Ln+1 are provided to correspond to the scanning lines Y1 to Yn, and supply a variable voltage to the respective pixels 2 constituting the display unit 1. In addition, the power lines L1 to Ln+1 extend in a direction intersecting with the data lines X1 to Xm, that is, in a direction similar to the scanning lines Y1 to Yn. A pixel row of m dots corresponding to an i-th ($1 \leqq i \leqq n$) scanning line Yi is coupled to both an i-th power line L(i) and a (i+1)-th power line L(i+1) adjacent to the i-th power line L(i). In this way, since a pair of power lines vertically adjacent to each other is coupled to one pixel row, the number of power lines L required for the entire display unit is larger than the number of scanning lines Y by one.

A control circuit 5 synchronously controls a scanning line driving circuit 3, a data line driving circuit 4, and a power line control circuit 6, based on a vertical synchronizing signal Vs, a horizontal synchronizing signal Hs, a dot clock signal DCLK, and a gray-scale signal output from devices located at the upstream positions thereof. These circuits 3, 4, and 6 perform display control on the display unit 1 in concert with each other under the synchronous control.

The scanning line driving circuit 3 mainly comprises a shift register and an output circuit, and selects the scanning lines Y1 to Yn to output a scanning signal SEL to them. The scanning signal SEL has either of two signal levels, that is, a high voltage level (hereinafter, referred to as an 'H level') or a lower voltage level (hereinafter, referred to as an 'L level'). The scanning line Y corresponding to a pixel row to which data will be written is set to an H level, and other scanning lines Y are set to an L level. In this way, the scanning lines Y are sequentially selected in a predetermined order (in general, in the direction of the uppermost part to the lowermost part) of selection for a period of time (1F) at which a frame image is displayed.

The data line driving circuit 4 mainly comprises a shift register, a line latch circuit, and an output circuit. The data line driving circuit 4 simultaneously performs the output of data to the pixel row to which current data is written within one horizontal scanning period (1H) and the point-sequential latch of data related to the pixel row to which data will be written within the next one horizontal scanning period (1H). Within a certain 1H, m data corresponding to the number of data lines X are sequentially latched. Then, within the next 1H, the latched m data are simultaneously output to the corresponding data lines X1 to Xm as a data current Idata. The present embodiment relates to a current program method. Therefore, when the current program method is adopted, the data line driving circuit 4 comprises a variable current source for converting data (a data voltage Vdata) corresponding to the gray scale of the pixel 2 into a data current Idata. Meanwhile, when a voltage program method is adopted as in a second exemplified embodiment, which will be described later, the data line driving circuit 4 need not comprise the variable current source, and the data voltage Vdata of a voltage level defining the gray scale of the pixel 2 is output to the data lines X1 to Xm.

In addition, the power line control circuit 6 mainly comprises a shift register and an output circuit. The voltage of the power lines L1 to Ln+1 is set to be variable in synchronism with the selection of the scanning lines Y by the scanning line driving circuit 3, and is set to a power voltage Vdd higher than a reference voltage Vss (for example, zero voltage) or a voltage Vrvs lower than the reference voltage Vss.

Figure 2:
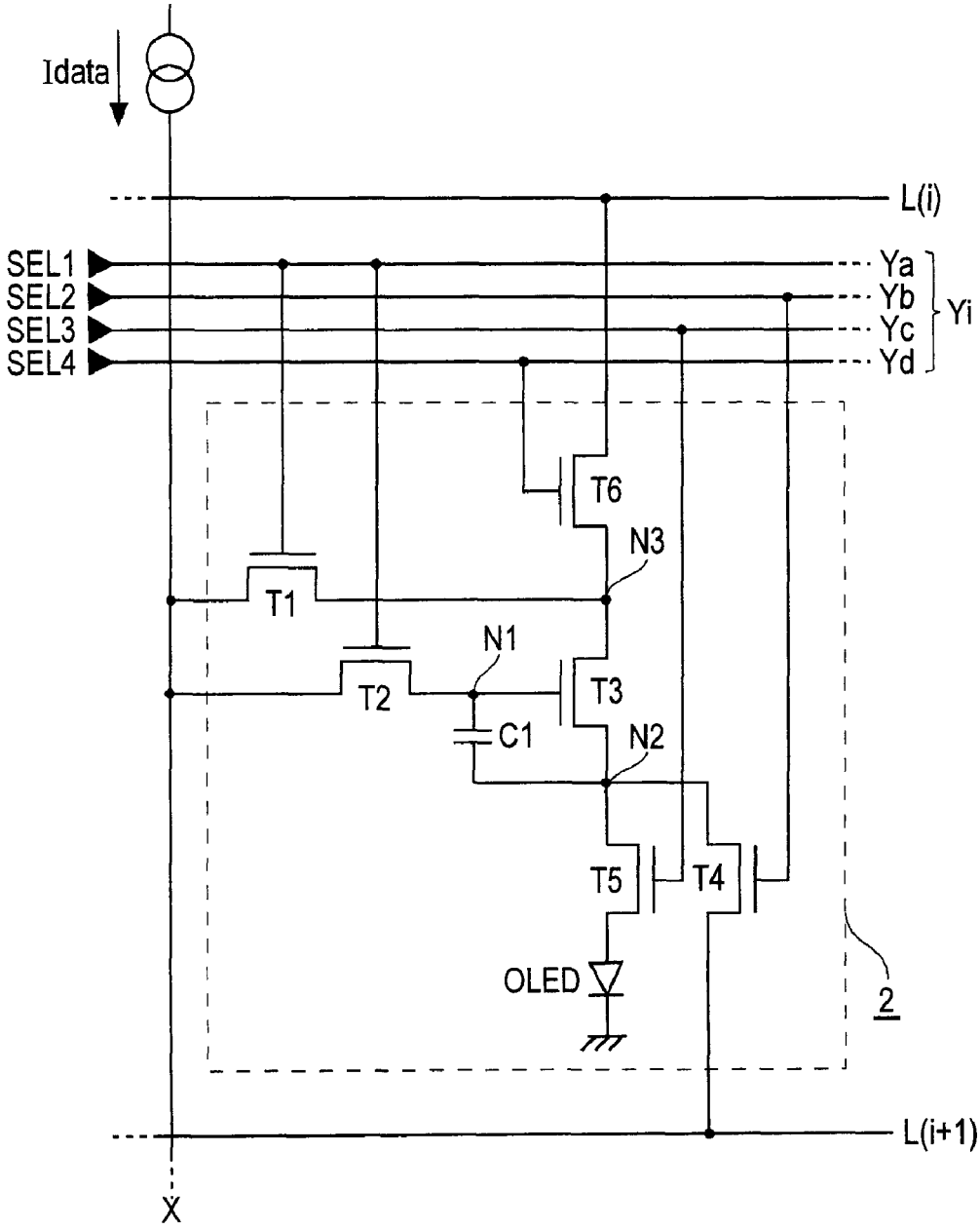
FIG. 2 is a circuit diagram of a pixel circuit according to a first exemplified embodiment.

FIG. 2 is a circuit diagram of a pixel driven in a voltage follower type current program method according to the present embodiment. Four scanning lines Ya to Yd constituting an i-th scanning line Yi, an i-th power line L(i) corresponding to the scanning line Yi, and a (i+1)-th power line L(i+1) are coupled to one pixel circuit in an i-th pixel row. Herein, the i-th and (i+1)-th lines are not only physically adjacent to each other on the display unit 1, but also adjacent to each other in the order of line-sequential scanning.

Each of the pixel circuits comprises an organic EL element OLED, which is an example of a current driven type element, six transistors T1 to T6, and a capacitor C1 for holding data. In the present embodiment, since a TFT is made of amorphous silicon, the channel types of all transistors T1 to T6 are an N type, but are not limited thereto (which are similar to the second exemplified embodiment described later). In the present specification, in each transistor, which is a three-terminal element having a source, a drain, and a gate, one of the source and the drain is called 'one terminal', and the other is called 'the other terminal'.

A gate of the switching transistor T1 is coupled to a first scanning line Ya through which a first scanning signal SEL1 is supplied, and the conduction of the switching transistor T1 is controlled by the scanning signal SEL1 One terminal of the switching transistor T1 is coupled to a data line X through which a data current Idata is supplied, and the other terminal thereof is coupled to a node N3. Both one terminal of the switching transistor T6 and one terminal of a driving transistor T3 as well as the switching transistor T1 are coupled to the node N3. The other terminal of the switching transistor T6 is coupled to the power line L(i), and a gate thereof is coupled to a fourth scanning line Yd through which a fourth scanning signal SEL4 is supplied, so that the conduction of the switching transistor T6 is controlled by the scanning signal SEL4. Meanwhile, a gate of a switching transistor T2 is coupled to the first scanning line Ya through which the first scanning signal SEL1 is supplied, and the conduction of the switching transistor T2 is controlled by the scanning signal SEL1, similar to the switching transistor T1. One terminal of the switching transistor T2 is coupled to the data line X, and the other terminal thereof is coupled to a node N1. Both one electrode of the capacitor C1 and the gate of the driving transistor T3 as well as the switching transistor T2 are coupled to the node N1. The other electrode of the capacitor C1 is coupled to a node N2. The other terminal of the driving transistor T3, one terminal of the switching transistor T4, and one terminal of the switching transistor T5 as well as the capacitor C1 are coupled to the node N2. The capacitor C1 is provided between the nodes N1 and N2 corresponding to the source and gate of the driving transistor T3, thereby constituting a voltage follower-type circuit. The other terminal of the switching transistor T4 is coupled to the power line L(i+1), and the gate thereof is coupled to the second scanning line Yb through which the second scanning signal SEL2 is supplied, so that the conduction of the switching transistor T4 is controlled by the second scanning signal SEL2. The other terminal of the switching transistor T5 is coupled to an anode of the organic EL element OLED, and a gate thereof is coupled to the third scanning line Yc through which a third scanning signal SEL3 is supplied, so that the conduction of the switching transistor T5 is controlled by the third scanning signal SEL3. A fixed reference voltage Vss is applied to the anode, that is, a counter electrode of the organic EL element OLED.

Figure 3:
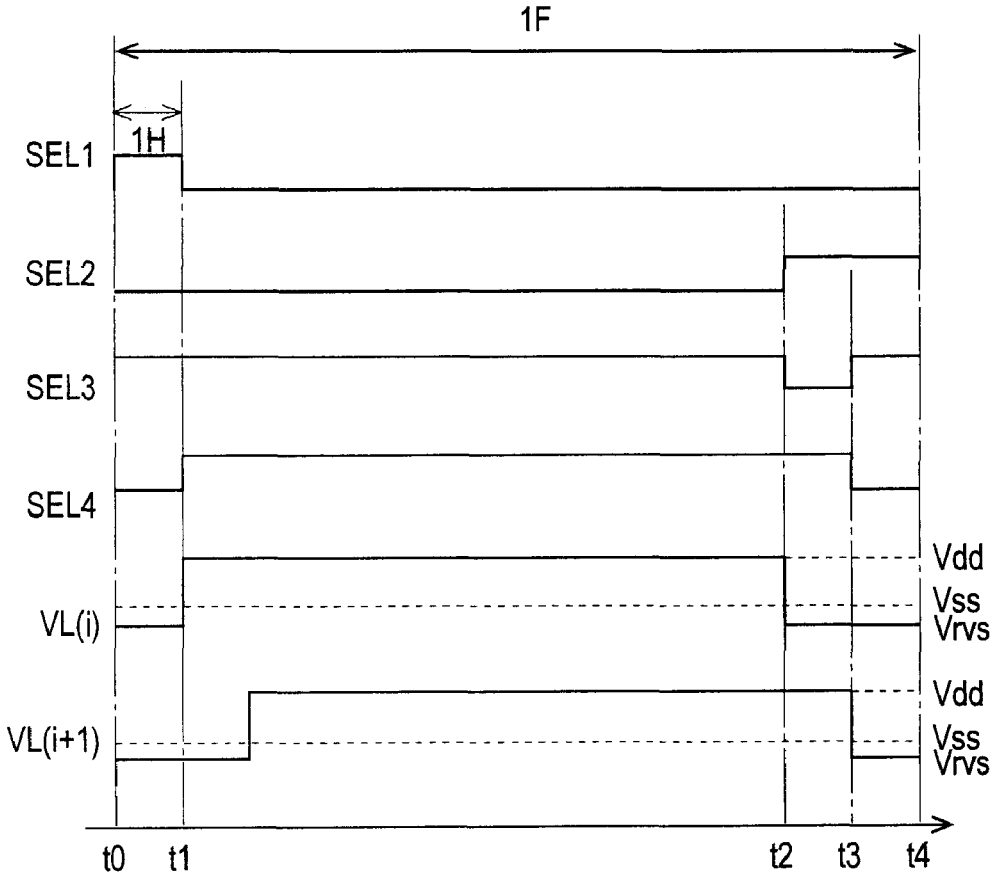
FIG. 3 is a timing chart illustrating the operation of the pixel circuit according to the first exemplified embodiment.

FIG. 3 is a timing chart illustrating the operation of the pixel circuit shown in FIG. 2. A series of operation process in a period of t0 to t4 corresponding the above-mentioned 1F is mainly divided into the following four processes: a data writing process within an initial period of t0 to t1; a driving process within a period of t1 to t2; a first reverse bias applying process within a period of t2 to t3; and a second reverse bias applying process within a period of t3 to t4.

Figure 4:
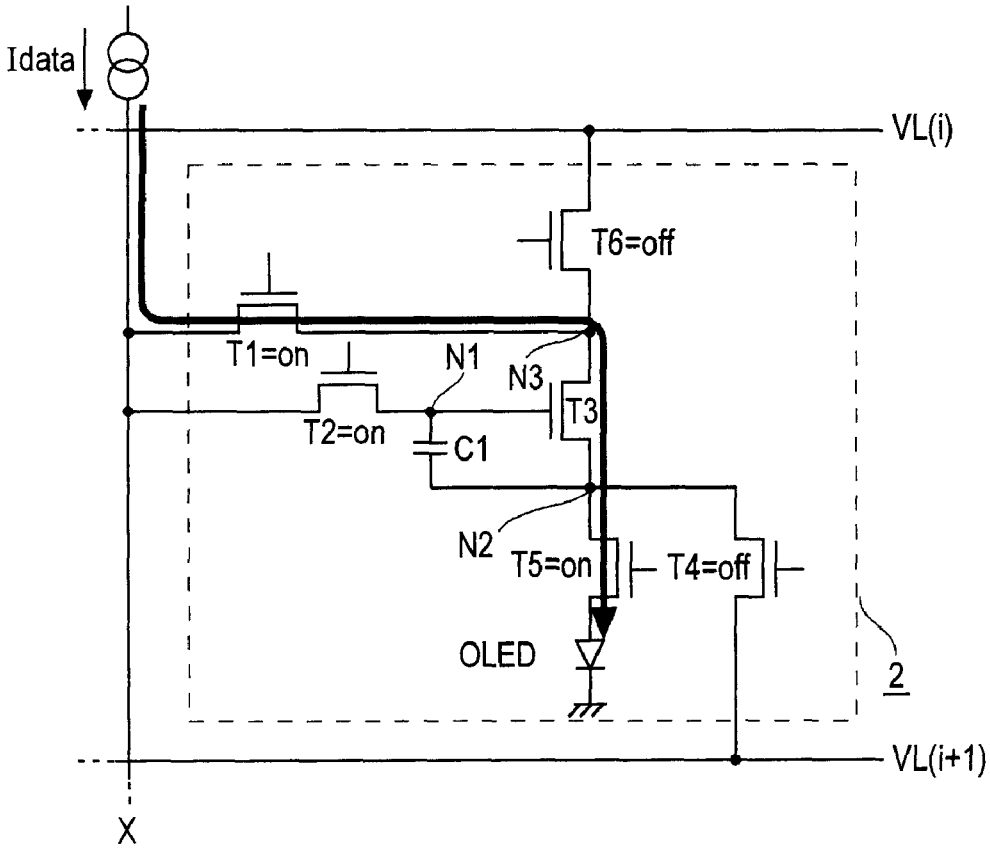
FIG. 4 is an explanatory view illustrating the operation within a data writing period.

First, within the data writing period of t0 to t1, data is written to the capacitor C1 by the operation shown in FIG. 4. Specifically, the first scanning signal SEL1 is an H level, and thus both the switching transistors T1 and T2 are turned on. Then, the node N3 corresponding to the drain of the driving transistor T3 is electrically coupled to the data line X. At that time, the gate and drain of the driving transistor T3 are electrically coupled to each other by the transistors T1 and T2 and the data line X to have a diode connection state. In addition, since the second scanning signal SEL2 is an L level and the third scanning signal SEL3 is an H level, the switching transistor T4 is turned off, and the switching transistor T5 is turned on. Then, a voltage VL(i+1) (=Vrvs) is not applied to the node N2 through the power line L(i+1), and the node N2 is electrically coupled to the anode of the organic EL element OLED. In addition, since the fourth scanning signal SEL4 is the L level, the switching transistor T6 is turned off. Then, a voltage VL(i) is not applied to the node N3 through the power line L(i). As a result, as indicated by an arrow in FIG. 4, the data current Idata flows in the direction from the data line X to the reference voltage Vss through the transistors T1, T3, and T5 and the organic EL element OLED in this order. The data current Idata supplied through the data line X flows through the channel of the driving transistor T3, and a gate voltage Vg corresponding to the data current Idata is generated at the node N1. Then, electric charge corresponding to the generated gate voltage Vg is accumulated in the capacitor C1, and data corresponding to the accumulated electric charge is written. As described above, within the data writing period of t0 to t1, the driving transistor T3 functions as a programming transistor for writing data to the capacitor C1. In addition, since the path of the data current Idata includes the organic EL element OLED, the organic EL element OLED starts to emit light in the data writing process.

Figure 5:
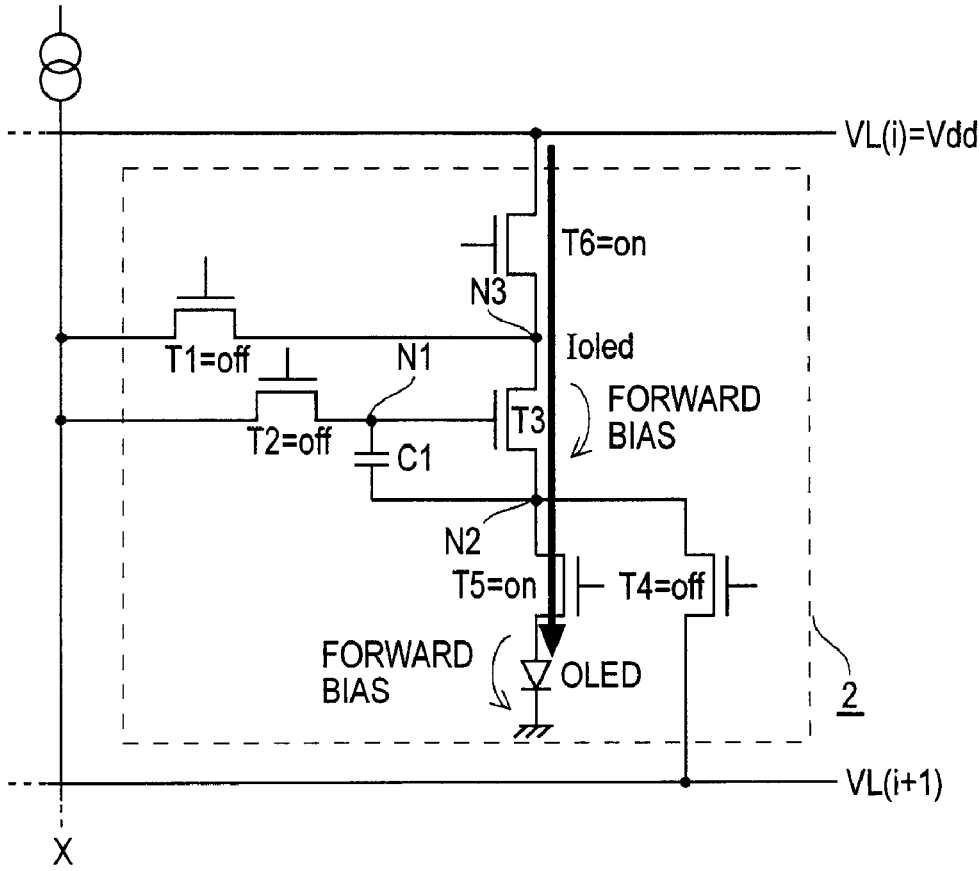
FIG. 5 is an explanatory view illustrating the operation within a driving period.

Next, within the driving period of t1 to t2, according to the operation shown in FIG. 5, a driving current Ioled passes through the organic EL element OLED, causing the organic EL element OLED to emit light. When the writing period of t0 to t1 corresponding to 1H (that is, a period in which one scanning line Y is selected) is passed, the first scanning signal SEL1 falls to the L level, and then both the transistors T1 and T2 are turned off. Then, the node N3 is electrically disconnected from the data line X to which the data current Idata is supplied, and then the diode connection of the driving transistor T3 is released. However, even when the diode connection is released, the gate voltage Vg corresponding to the data held in the capacitor C1 is continuously applied to the node N1 corresponding to the gate of the driving transistor T3. Then, the fourth scanning signal SEL4 synchronously rises to the H level when the first scanning signal SEL1 becomes an L level, and the switching transistor T6 is turned on. In the present specification, the term 'synchronism' does not mean exactly the same timing, but means almost the same timing at which a little time offset is allowable due to the margin of a device design. The voltage VL(i) of the power line L(i), that is, the power voltage Vdd higher than the reference voltage Vss is applied to the node N3. In addition, similar to the previous data writing period of t0 to t1, even within the period of t1 to t2, the switching transistor T4 is an off state, and the switching transistor T5 is an on state. As a result, a forward bias is applied to both the driving transistor T3 and the organic EL element OLED, and thus the driving current Ioled flows from the power line L(i), which is set to VL(i)=Vdd, to the reference voltage Vss on the side of the counter electrode via the transistors T6, T3, and T5 and the organic EL element OLED in this order. The driving current Ioled passing through the organic EL element OLED corresponds to a channel current of the driving transistor T3, and the current level thereof is set by the gate voltage Vg due to the accumulated electric charge (the held data) in the capacitor C1. The organic EL element OLED emits light with brightness corresponding to the driving current Ioled generated from the driving transistor T3, thereby setting the gray scale of the pixel 2.

Figure 6:
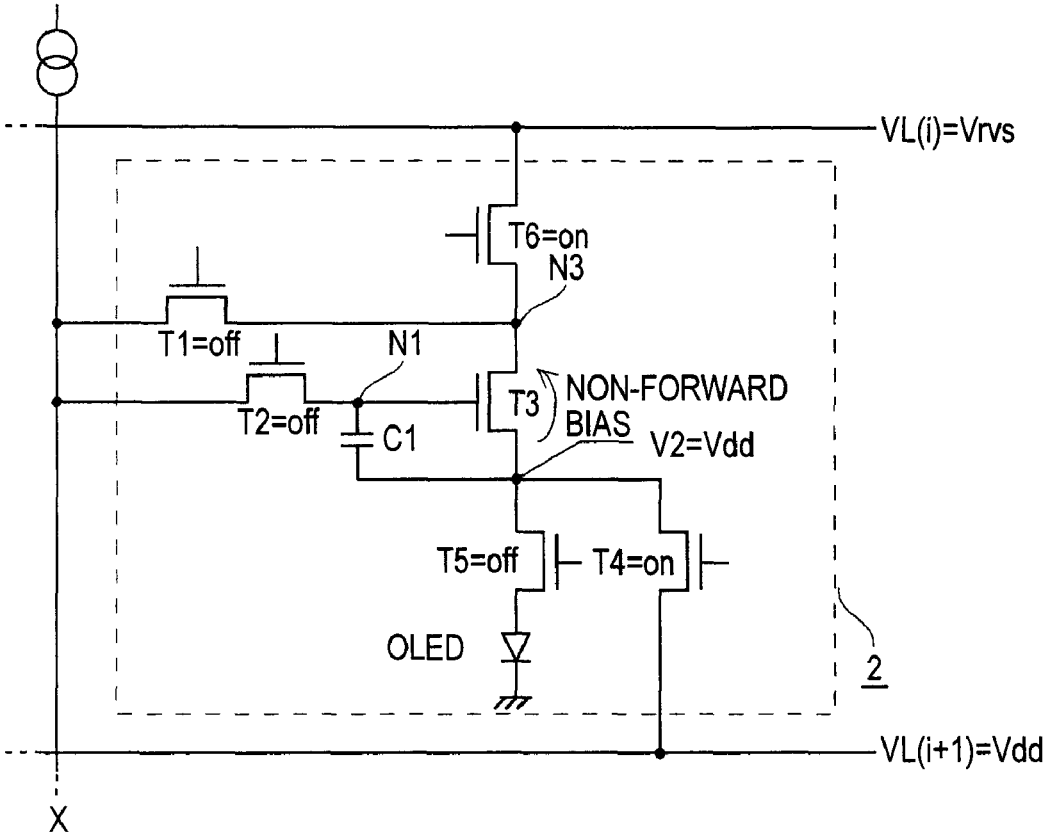
FIG. 6 is an explanatory view illustrating the operation within a first reverse biasing period.

Subsequently, within the first reverse bias applying period of t2 to t3, according to the operation shown in FIG. 6, a non-forward bias, that is, a bias different from the forward bias within the driving period of t1 to t2 is applied to the driving transistor T3. Specifically, the second scanning signal SEL2 rises to the H level in synchronism with the descent of the third scanning signal SEL3 to the L level. Then, the node N2 is electrically disconnected from the anode of the organic EL element OLED, and a voltage V2 of the node N2 is set to Vdd by the power line L(i) which is set to VL(i+1)=Vdd. In addition, even within the period of t2 to t3, although the switching transistor T6 is in the on state, the voltage VL(i) of the power line L(i) is set to a voltage different from the VL(i)=Vdd within the previous driving period of t1 to t2, that is, to the voltage Vrvs lower than the reference voltage Vss. Therefore, the voltage V2 of the node N2 becomes Vdd higher than the voltage VL(i)(=Vrvs) of the power line L(i). As a result, the bias (the voltage relationship between the nodes N2 and N3) acting on the driving transistor T3 is opposite to the bias applied within the previous driving period of t1 to t2. As such, by applying a reverse bias (a form of an non-forward bias) to the driving transistor T3, it is possible to prevent the deterioration or variation of characteristics, such as the generation of a phenomenon in which a threshold value Vth of the driving transistor T3 shifts, that is, a threshold value Vth of the driving transistor T3 varies with the lapse of time, by continuously applying the bias in the same direction.

Figure 7:
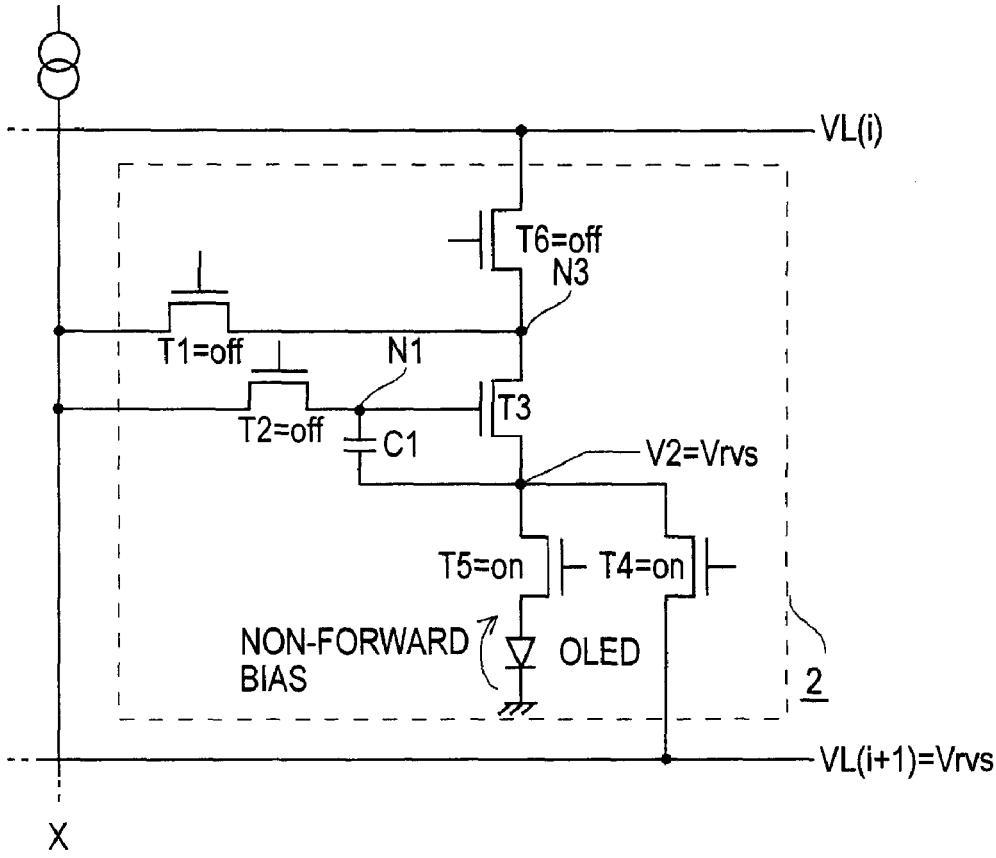
FIG. 7 is an explanatory view illustrating the operation within a second reverse biasing period.

Finally, within the second reverse bias applying period of t3 to t4, according to the operation shown in FIG. 7, a non-forward bias, that is, a bias different from the forward bias within the driving period of t1 to t2 is applied to the organic EL element OLED. Specifically, the third scanning signal SEL3 rises to the H level in synchronism with the descent of the fourth scanning signal SEL4 to the L level. Then, the node N3 is electrically disconnected from the power line L(i), and the node N2 is electrically coupled to the anode of the organic EL element OLED. In addition, even within the period of t3 to t4, although the switching transistor T4 is in the on state, the voltage VL(i+1) of the power line L(i+1) is set to the voltage Vrvs different from the VL(i+1)=Vdd within the previous period of t2 to t3. Therefore, the voltage V2 of the node N2 becomes Vrvs lower than the reference voltage Vss of the counter electrode. As a result, the bias acting on the organic EL element OLED is opposite to the bias applied within the driving period of t1 to t2. Therefore, it is possible to lengthen the lifespan of the organic EL element OLED by applying a reverse bias to the organic EL element OLED.

As shown in FIG. 3, a variation in the voltage VL(i+1) of the power line L(i+1) according to the lapse of time is offset against that of the power line L(i) by 1H. An operation process using the power lines L(i+1) and L(i+2) is performed on a (i+1)-th pixel row with the timing t1 after the lapse of 1H from the timing t0 as a starting point, similar to the above-mentioned process (the same operation process is performed on the subsequent pixel rows).

In this way, in the present embodiment, a pair of adjacent power lines L(i) and L(i+1) is coupled to a pixel circuit, and the voltages VL(i) and VL(i+1) thereof are set to be variable in synchronism with the selection of the scanning lines Y. The voltages VL(i) and VL(i+1) have the same waveform, and are offset against each other by a predetermined period (herein, by 1H). In addition, the power line L(i+1) to be originally used for the operation process on the (i+1)-th pixel row is also used for the operation process on the i-th pixel row. Therefore, it is possible to achieve the commonality of the power lines L, and thus to reduce the number of the power lines L.

According to the present embodiment, since the voltages VL(i) and VL(i+1) of the power lines L(i) and L(i+1) are set to be variable, a non-forward bias is applied to both the driving transistor T3 and the organic EL element OLED. By applying a non-forward bias to the driving transistor T3, it is possible to effectively suppress the variation of characteristics, such as the shift of the threshold voltage Vth of the driving transistor 3. In addition, by applying a non-forward bias to the organic EL element OLED, it is possible to lengthen the lifespan of the organic EL element OLED. A method of applying the voltages VL(i) and VL(i+1) of the power lines L(i) and L(i+1) can reduce a load on the circuit, compared to a method of applying a voltage Vca of the counter electrode, and is also advantageous to the setting of a frame.

2. Second Exemplified Embodiment

Figure 8:
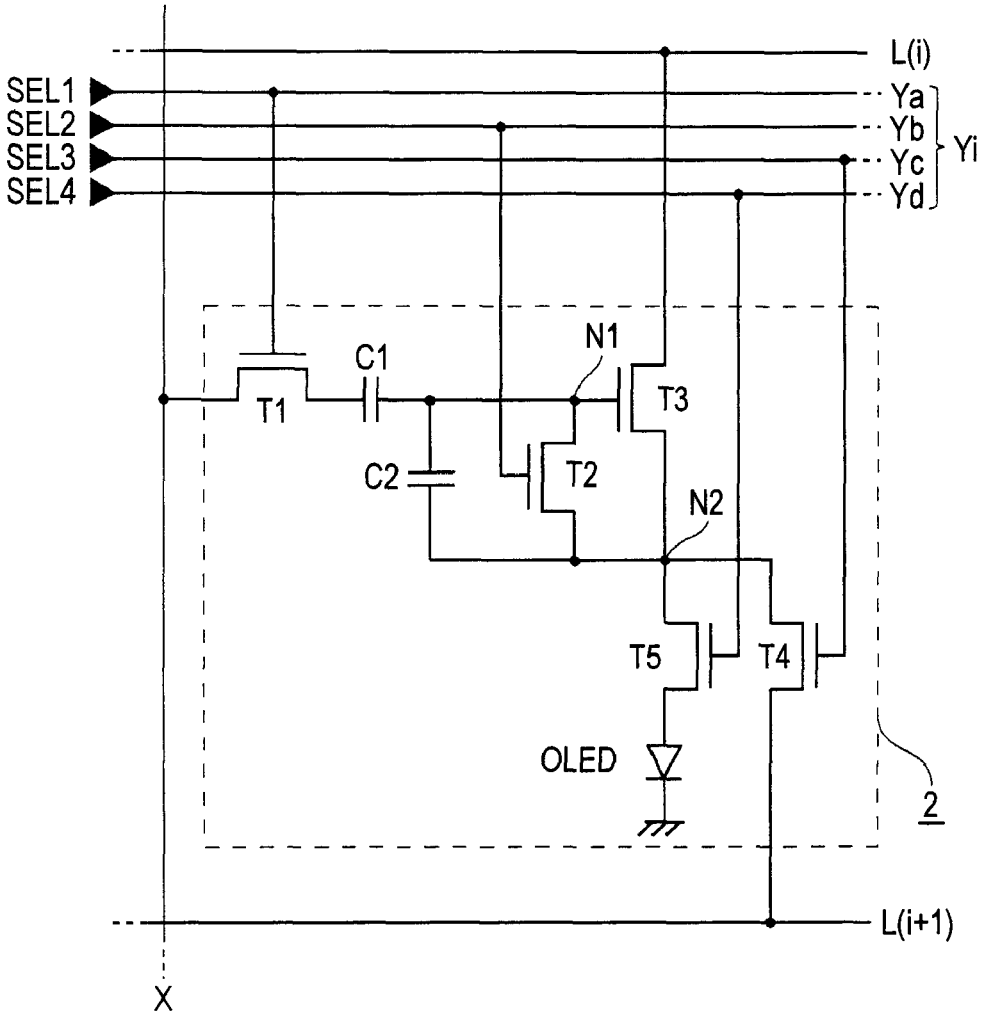
FIG. 8 is a circuit diagram of a pixel circuit according to a second exemplified embodiment.

FIG. 8 is a circuit diagram of a pixel driven in a voltage follower type voltage program method according to the present embodiment. Four scanning lines Ya to Yd constituting an i-th scanning line Yi, an i-th power line L(i) corresponding to the scanning line Yi, and a (i+1)-th power line L(i+1) adjacent to the i-th power line L(i) are coupled to one pixel circuit in an i-th pixel row. The pixel circuit comprises an organic EL element OLED, five transistors T1 to T5, and capacitors C1 and C2 each holding data.

A gate of the switching transistor T1 is coupled to a first scanning line Ya through which a first scanning signal SEL1 is supplied, and the conduction of the switching transistor T1 is controlled by the scanning signal SEL1 One terminal of the switching transistor T1 is coupled to a data line X through which a data voltage Vdata is supplied, and the other terminal thereof is coupled to one electrode of a first capacitor C1. The other electrode of the first capacitor C1 is coupled to a node N1. A gate of a driving transistor T3, one terminal of a switching transistor T2, and one electrode of a second capacitor C2 as well as the first capacitor C1 are coupled to the node N1. One terminal of the driving transistor T3 is coupled to a power line L(i), and the other terminal thereof is coupled to a node N2. The other terminal of the switching transistor T2, the other electrode of the second capacitor C2, one terminal of the switching transistor T4, and one terminal of the switching transistor T5 as well as the driving transistor T3 are coupled to the node N2. The capacitor C2 is provided between the nodes N1 and N2 corresponding to the source and gate of the driving transistor T3, thereby constituting a voltage follower-type circuit. The other terminal of the switching transistor T4 is coupled to the power line L(i+1), and the gate thereof is coupled to a third scanning line Yc through which a third scanning signal SEL3 is supplied, so that the conduction of the switching transistor T4 is controlled by the third scanning signal SEL3. The other terminal of the switching transistor T5 is coupled to an anode of the organic EL element OLED, and a gate thereof is coupled to a scanning line Yd through which a fourth scanning signal SEL4 is supplied, so that the conduction of the switching transistor T5 is controlled by the fourth scanning signal SEL4. A fixed reference voltage Vss is applied to the anode, that is, a counter electrode of the organic EL element OLED.

Figure 9:
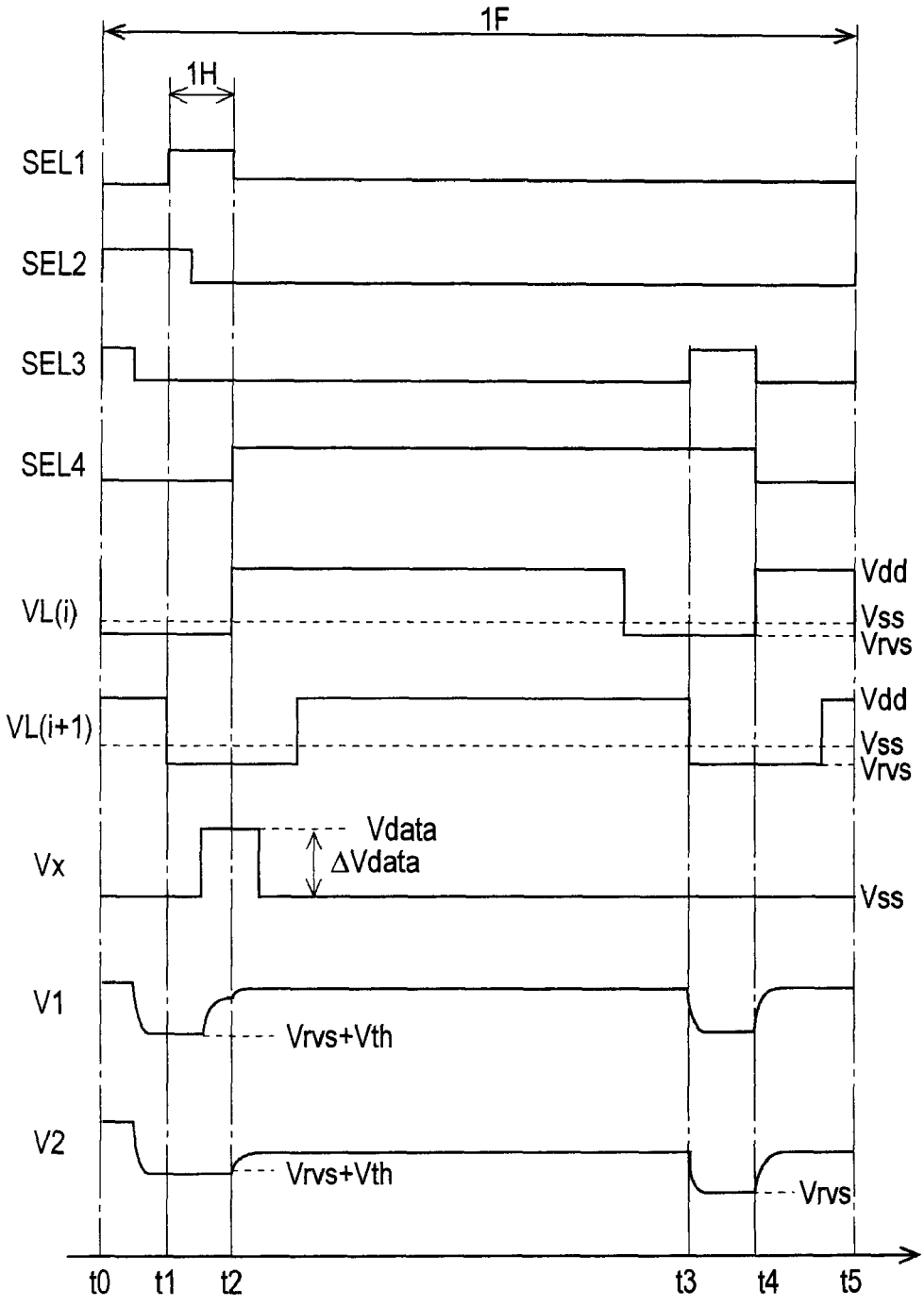
FIG. 9 is a timing chart illustrating the operation of the pixel circuit according to the second exemplified embodiment.

FIG. 9 is a timing chart illustrating the operation of the pixel circuit shown in FIG. 8. A series of operation process in a period of t0 to t5 corresponding to the 1F is mainly divided into the following five processes: an initializing process within a period of t0 to t1; a data writing process within a period of t1 to t2; a driving process within a period of t2 to t3; a reverse bias applying process within a period of t3 to t4; and a waiting process within a period of t4 to t5.

Figure 10:
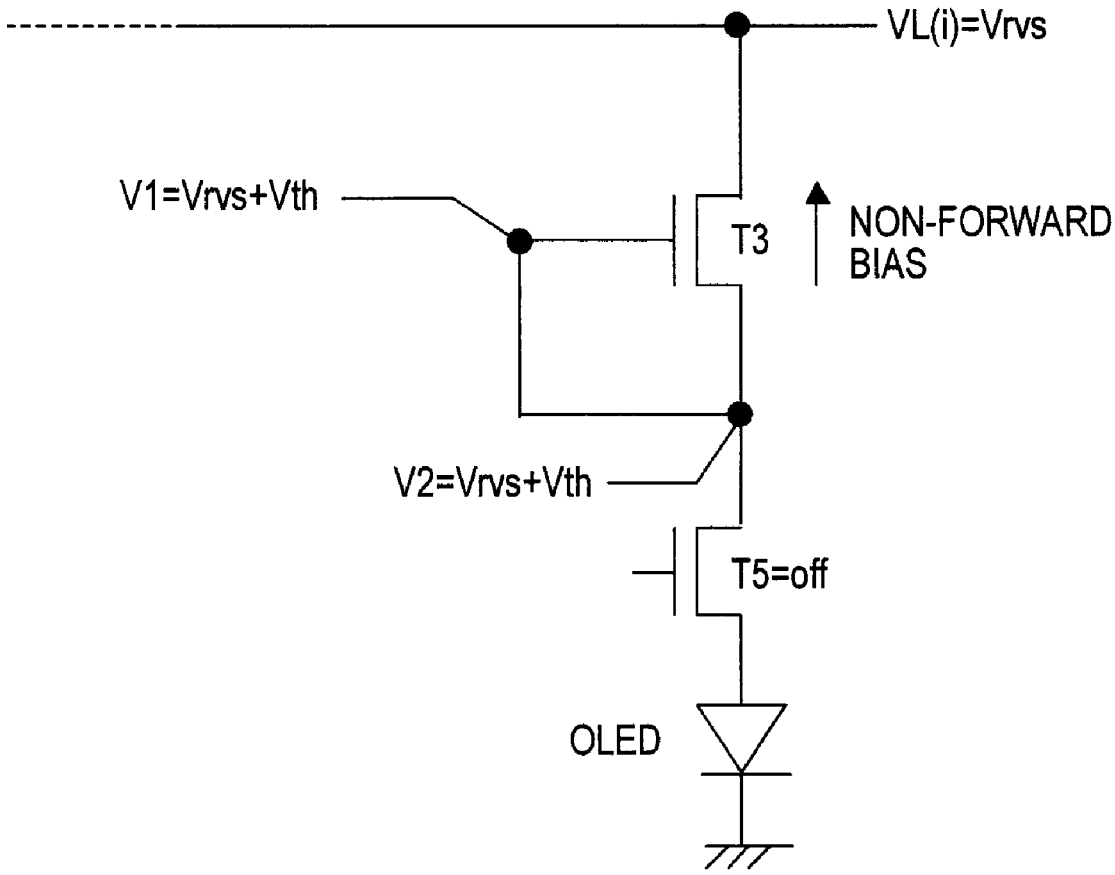
FIG. 10 is an explanatory view illustrating the operation within an initializing period.

First, within the initializing period of t0 to t1, the application of the non-forward bias to the driving transistor T3 and the compensation of the voltage Vth are simultaneously performed according to the operation shown in FIG. 10. Specifically, the first scanning signal SEL1 becomes an L level, and both the switching transistors T1 and T5 are turned off. Then, the first capacitor C1 is electrically disconnected from the data line X, and the organic EL element OLED is electrically disconnected from the node N2. In addition, the second scanning signal SEL2 becomes the H level, and the switching transistor T2 is turned off. Within a part (the first half) of the initializing period of t0 to t1, the third scanning signal SEL3 becomes the H level, and the switching transistor T4 is turned on. Herein, the power line L(i) is set to VL(i)=Vrvs, and the voltage V2 of the node N2 becomes a voltage higher than the voltage VL(i) of the power line L(i), that is, the voltage Vrvs since the voltage Vdd is supplied through the power line L(i+1). Due to such voltage relations, a bias is applied to the driving transistor T3 in a direction opposite to the direction in which the driving current Ioled flows, thereby achieving diode connection in which the gate and drain (a terminal on the side of the node N2) of the driving transistor T3 are coupled to each other in the forward direction. Then, when the third scanning signal SEL3 falls to the L level to turn on the switching transistor T4, the voltage V2 (and the voltage V1 of the node N1 directly connected with the voltage V2) of the node N2 is set to an offset voltage (Vrvs+Vth). The capacitors C1 and C2 each coupled to the node N1 is set to an electric charge state causing the voltage V1 of the node N1 to be the offset voltage (Vrvs+Vth) prior to the writing of data. Therefore, it is possible to compensate the threshold value Vth of the driving transistor T3 by offsetting the voltage of the node N1 to the offset voltage (Vrvs+Vth) prior to the writing of data.

Figure 11:
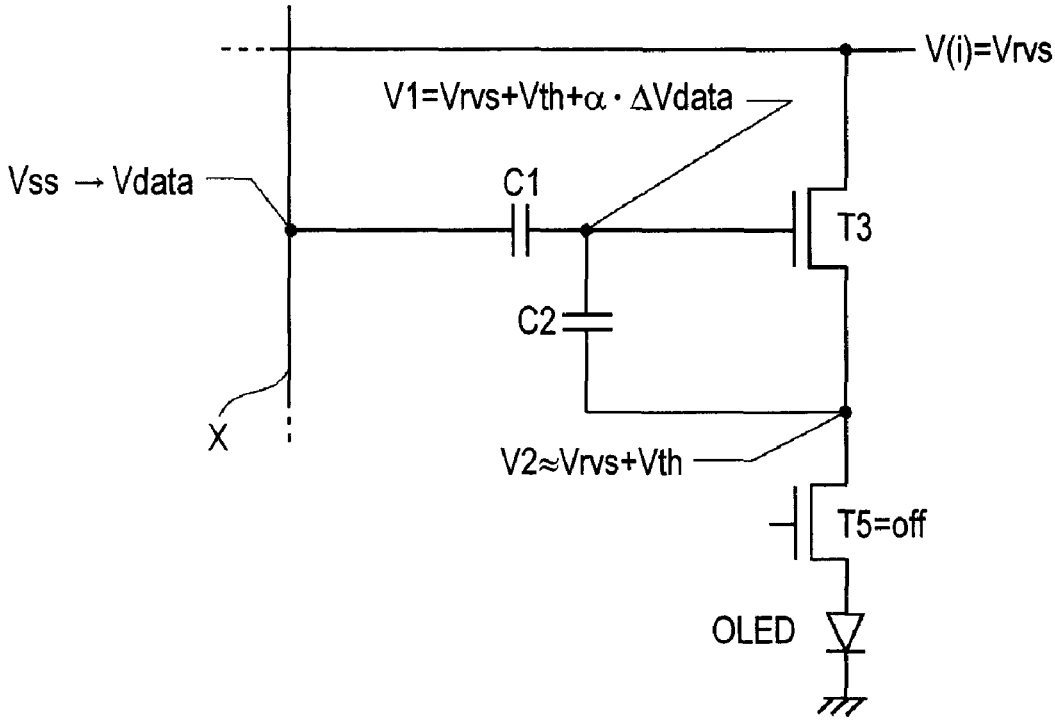
FIG. 11 is an explanatory view illustrating a modification of the main part shown in FIG. 10.

Further, according to the operation shown in FIG. 11, data are written to the capacitors C1 and C2 within the data writing period of t1 to t2 on the basis of the offset voltage (Vrvs+Vth) that has been set in the initializing period of t0 to t1. More specifically, the second scanning signal SEL2 falls to the L level to turn on the switching transistor T2, and then the diode connection of the driving transistor T3 is released. The first scanning signal SEL1 rises to the H level in synchronism with the descent of the second scanning signal SEL2, and then the switching transistor T1 turns on. Then, the data line X is electrically coupled to the first capacitor C1. At a point of time after the lapse of a predetermined time from the timing t1, a voltage Vx of the data line X rises from the reference voltage Vrvs to the data voltage Vdata. The node N1 is capacitively coupled to data line X with the first capacitor C1 interposed therebetween. Therefore, the voltage V1 of the node N1 increases by $\alpha \cdot \Delta Vdata$ on the basis of the offset voltage (Vrvs+Vth) according to a voltage variation $\Delta Vdata$ (=Vdata−Vss) of the data line X, as represented by the expression 1. In the expression 1, a coefficient $\alpha$ is univocally specified according to the capacitance ratio of capacitance Ca of the first capacitor C1 to capacitance Cb of the second capacitor C2 ($\alpha$=Ca/(Ca+Cb)).

$$V1 = Vrvs + Vth + \alpha \cdot \Delta Vdata \qquad \text{[Expression 1]}$$
$$= Vrvs + Vth + \alpha(\Delta Vdata - Vss)$$

The electric charges corresponding to the voltage V1 calculated by the expression 1 are written to the capacitors C1 and C2 as data. Within the period of t1 to t2, the voltage V2 of the node N2 is maintained substantially to the voltage Vrvs+Vth without being influenced by a variation in the voltage of the node N1. That is because the nodes N1 and N2 are capacitively coupled to each other with the second capacitor C2 interposed therebetween, and the capacitance of the capacitor C2 is considerably less than that of the organic EL element OLED. The reason why the power line L(i) is set to VL=Vss within the period of t1 to t2 is that the driving current Ioled does not flow to regulate the emission of light from the organic EL element OLED. In addition, since the switching transistor T5 is an off state within the period of t1 to t2, the driving current Ioled does not flow, so that the organic EL element OLED does not emit light.

Figure 12:
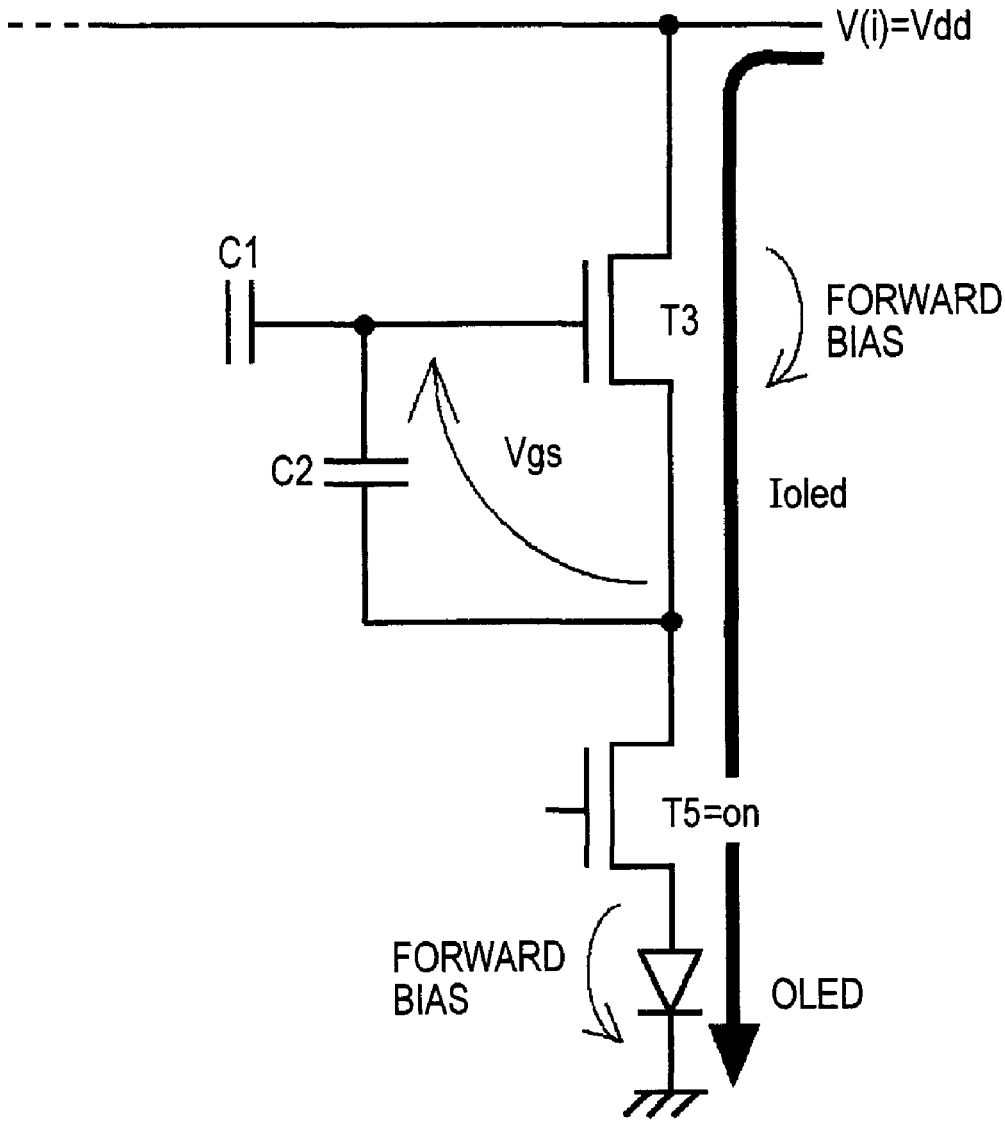
FIG. 12 is an explanatory view illustrating the operation within a data writing period.

Within the period of t2 to t3, according to the operation shown in FIG. 12, the driving current Ioled corresponding to a channel current of the driving transistor T3 is supplied to the organic EL element OLED to allow it to emit light. More specifically, the first scanning signal SEL1 falls to the L level to turn off the switching transistor T1. Then, the first capacitor C1 is electrically disconnected from the data line X through which the data voltage Vdata is supplied, but the voltage corresponding to data held in the capacitors C1 and C2 is continuously applied to the gate N1 of the driving transistor T3. Then, the fourth scanning signal SEL4 rises to the H level in synchronism with the descent of the first scanning signal SEL1 to turn on the switching transistor T5, and the voltage VL(i) of the power line L(i) also rises from Vrvs to Vdd. As a result, the driving current Ioled can flow in a direction from the power line L(i) to the reference voltage Vss of the counter electrode. Assuming that the driving transistor T3 is operated in a saturated region, the driving current Ioled (a channel current Ids of the driving transistor T3) passing through the organic EL element OLED is calculated based on the expression 2. In the expression 2, 'Vgs' is a voltage between the gate and source of the driving transistor T3, and a gain coefficient β is a coefficient univocally specified by the mobility p of carriers, a gate capacitance A, a channel width W, and a channel length L of the driving transistor T3 (β=μAW/L).

$$Ioled = Ids = \beta/2(Vgs - Vth)^2 \quad \text{[Expression 2]}$$

Herein, when substituting the voltage V1 calculated by the expression 1 for the gate voltage Vg of the driving transistor T3, the expression 2 is changed into the following expression 3:

$$\begin{aligned} Ioled &= \beta/2(Vg - Vs - Vth)^2 \quad \text{[Expression 3]} \\ &= \beta/2\{(Vrvs + Vth + \alpha \cdot \Delta Vdata) - Vs - Vth\}^2 \\ &= \beta/2(Vrvs + \alpha \cdot \Delta Vdata - Vs)^2 \end{aligned}$$

A point to be attended to in the expression 3 is that the driving current Ioled generated from the driving transistor T3 does not depend on the threshold value Vth of the driving transistor T3 since the threshold value Vth is cancelled. Therefore, when the data writing is performed on the capacitor 2 C1 and C2 based on the threshold value Vth, it is possible to generate the driving current Ioled without being influenced by the offset of the threshold value Vth caused by errors in manufacture or a variation in time.

The brightness of light emitted from the organic EL element OLED is determined by the driving current Ioled corresponding to the data voltage Vdata (the voltage variation ΔVdata), and thus the gray scale of the pixel 2 can be set. When the driving current Ioled flows through the path shown in FIG. 12, the source voltage V2 of the driving transistor T3 is higher than the original voltage Vrvs+Vth according to the voltage drop Ve1 caused by the resistance of the organic EL element OLED. However, since the gate N1 and source N2 of the driving transistor T3 are capacitively coupled to each other with the second capacitor C2 interposed therebetween, the gate voltage V1 increases with an increase of the source voltage V2. Therefore, the voltage Vgs between the gate and the source is substantially uniformly maintained.

Figure 13:
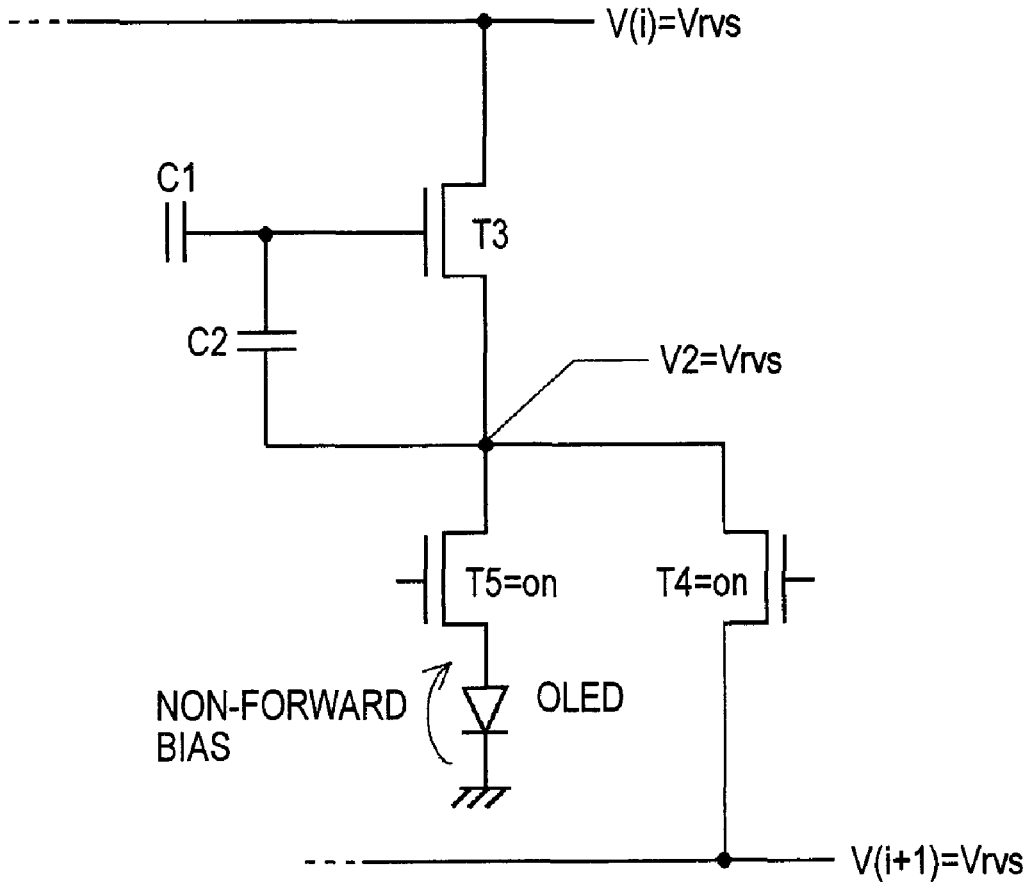
FIG. 13 is an explanatory view illustrating the operation within a reverse biasing period.

Within the reverse bias period of t3 to t4, according to the operation shown in FIG. 13, a non-forward bias is applied to the organic EL element OLED to lengthen its lifespan. More specifically, the third scanning signal SEL3 rises to the H level, and the voltage VL(i) of the power line L(i) is changed from Vdd to Vrvs. In addition, within the period of t3 to t4, the voltage VL(i+1) of the power line L(i+1) is Vrvs. Therefore, the voltage Vrvs of the power line L(i+1) is directly applied to the node N2, and thus the voltage V2 is equal to the voltage Vrvs. Thus, a reverse bias, which is a form of a non-forward bias, is applied to the organic EL element OLED.

The waiting period of t4 to t5 is a period for adjusting timing in which the voltages VL(i) and VL(i+1) are offset by a predetermined period (herein, by 1H) and have the same waveform. In addition, at the timing that is offset by 1H, an operation process using the power lines L(i+1) and L(i+2) is performed on a (i+1)-th pixel row that is selected subsequent to the i-th pixel row, similar to the above-mentioned process (the same process is performed on the subsequent pixel rows).

As described above, according to the present embodiment, it is possible to reduce the number of power lines L for the same reason as the first exemplified embodiment. In addition, it is possible to prevent the shift of Vth by applying a non-forward bias to the driving transistor T3, and to lengthen the lifespan of the organic EL element OLED by applying a non-forward bias to the organic EL element OLED.

Further, in the above-mentioned embodiments, the organic EL element OLED is used as an electro-optical element. However, the prevent invention is not limited thereto, and may also be widely applied to an electro-optical element in which brightness is set according to a driving current (an inorganic LED display device, a field emission display device, etc.) or an electro-optical device in which transmittance and reflectance depend on a driving current (an electrochromic display device, an electrophoresis display device, etc.).

Furthermore, the electro-optical devices according to the above-mentioned embodiments can be mounted to variable electronic apparatuses, such as, a television, a projector, a mobile phone, a portable terminal, a mobile computer, and a personal computer. When the above-mentioned electro-optical devices are mounted to those electronic apparatuses, the electronic apparatuses will more increase in value, and thus the purchasing power thereof will increase in the market. In addition, it should be understood that various changes, substitutions, and alterations can be made therein without departing from the spirit and scope of the present invention as defined by the appended claims. For example, the structure of the pixel circuit according to the present invention can be applied to an electronic circuit of an electronic apparatus, such as a biochip.

What is claimed is:

1. An electro-optical device comprising:
scanning lines;
data lines;
pixels arranged in correspondence with intersections of the scanning lines and the data lines; and
first and second power source lines that supply voltage to the pixels,
the pixels each having:
a current drive-type element having a first electrode and a second electrode; and
a drive transistor that controls a current flowing through the current drive-type element, the drive transistor being connected between the first power source line and the first electrode of the current drive-type element,
the second power source line being electrically connected between the drive transistor and the first electrode,
a reference voltage being applied to the second electrode,
the current drive-type element emitting light during a first period within a one frame period by a second voltage being supplied from the first power source line, the second voltage being higher than the reference voltage,
a first voltage lower than the reference voltage being supplied from the second power source line during a second period that is after the first period within the one frame period, and
the first power source line supplying the first voltage during the second period.

2. The electro-optical device according to claim 1, further comprising:
a first transistor that controls a current flowing to the current drive-type element, the first transistor being turned OFF during the second period.

3. The electro-optical device according to claim 2, the first transistor turning ON during a third period of the one frame period after the second period, and no voltage being supplied from either the first power source line or the second power source line during the third period.

4. The electro-optical device according to claim 3, the third period immediately following the second period.

5. The electro-optical device according to claim 1, the second power source line supplying the second voltage to another pixel leading up to the second period.

6. An electronic device comprising the electro-optical device as set forth in claim 1.

7. An electro-optical device comprising:

scanning lines;

data lines;

pixels arranged in correspondence with intersections of the scanning lines and the data lines; and first and second power source lines that supply voltage to the pixels;

the pixels each having:

a current drive-type element having a first electrode and a second electrode; and a drive transistor that controls a current that flows through the current drive-type element, the drive transistor being connected between the first power source line and the first electrode of the current drive-type element, the second power source line being electrically connected between the drive transistor and the first electrode, a reference voltage being applied to the second electrode, a first voltage lower than the reference voltage being supplied from the first power source line during a first period within a one frame period, the current drive-type element emitting light during a second period that is after the first period within the one frame period by a second voltage being supplied from the first power source line, the second voltage being higher than the reference voltage, and the second power source line supplying the first voltage during a third period of the one frame period after the second period.

8. The electro-optical device according to claim 7, further comprising:

a first transistor that controls a current flowing to the current drive-type element, the first transistor being turned ON during the second period.

9. The electro-optical device according to claim 7, the second power source line supplying the first voltage to another pixel during a fourth period of the one frame period that overlaps the first period and the second period.

10. The electro-optical device according to claim 7, the second power source line supplying the first voltage during the third period of the one frame period that immediately follows the second period.

11. An electronic device comprising the electro-optical device as set forth in claim 7.

* * * * *